US005361604A

United States Patent [19]

Pier et al.

[11] Patent Number: 5,361,604

[45] Date of Patent: Nov. 8, 1994

[54] BEVERAGE CHILLING RECEPTACLE

[76] Inventors: Steven J. Pier, 216 Garnet Ave., Newport Beach, Calif. 92662; Carl C. Jones, 2212 Verano Pl., Irvine, Calif. 92715

[21] Appl. No.: 89,767

[22] Filed: Jul. 9, 1993

[51] Int. Cl.[5] ..... F25D 3/08

[52] U.S. Cl. ..... 62/457.4; 62/371; 62/530

[58] Field of Search ..... 62/457.1, 457.2, 457.3, 62/457.4, 457.5, 371, 372, 529, 530

[56] References Cited

U.S. PATENT DOCUMENTS

| | | | |
|---|---|---|---|
| 2,711,766 | 6/1955 | Archer et al. | 150/0.5 |
| 3,205,678 | 9/1965 | Stoner | 62/457 |
| 3,302,427 | 2/1967 | Stoner et al. | 62/457 |
| 3,302,428 | 2/1967 | Stoner et al. | 62/457 |
| 3,360,957 | 1/1968 | Paquin | 62/457 |
| 3,417,573 | 12/1968 | Warner | 62/60 |
| 3,680,330 | 8/1972 | Canosa | 62/457 |
| 3,715,895 | 2/1973 | Devlin | 62/457 |
| 3,765,559 | 10/1973 | Sauey et al. | 220/15 |
| 4,163,374 | 8/1979 | Moore et al. | 62/457 |
| 4,183,226 | 1/1980 | Moore | 62/457 |
| 4,299,100 | 11/1981 | Crisman et al. | 62/457 |
| 4,378,625 | 4/1983 | Crisman et al. | 29/450 |
| 4,768,354 | 9/1988 | Barnwell | 62/457 |
| 4,793,149 | 12/1988 | Riche | 62/372 |

*Primary Examiner*—John M. Sollecito

[57] ABSTRACT

An improved portable and hand-held beverage chilling device, having water utilized as a coolant that can be frozen between non-permanently sealed walls of the device, is intended for chilling and subsequent maintenance of a canned or bottled beverage at its coldest liquid state, while providing direct consumption from its container. The beverage cooler features two cylindrical receptacles that are enclosed on one end. These receptacles, called shells, are of different diameter and height such that the inner is placed within the outer and a coolant is contained in the spacial void created. A beer or soft drink container is inserted within a cavity defined by the inner shell, thereby facilitating cooling. A threaded circular cap, with a circular hole of comparable diameter to that of the inner shell, is assembled by hand to the top of the inner shell in a snap-on interlocking fashion. The cap is secured by hand to the outer shell by means of mutually mating threads. Interlocking cap and inner shell, along with a threaded seal, provide complete hand assembly and permit the shells to be separated to allow the coolant water to be consumed, emptied, or refilled. An area of the inner shell under the beverage container deforms as the ice expands. This allows for volumes of ice to be used in the cooling process that are comparable to, or greater than, the volume of the beverage container itself. A removable insulation encompasses the entire exterior of the outer shell.

3 Claims, 6 Drawing Sheets

Fig. 5-A
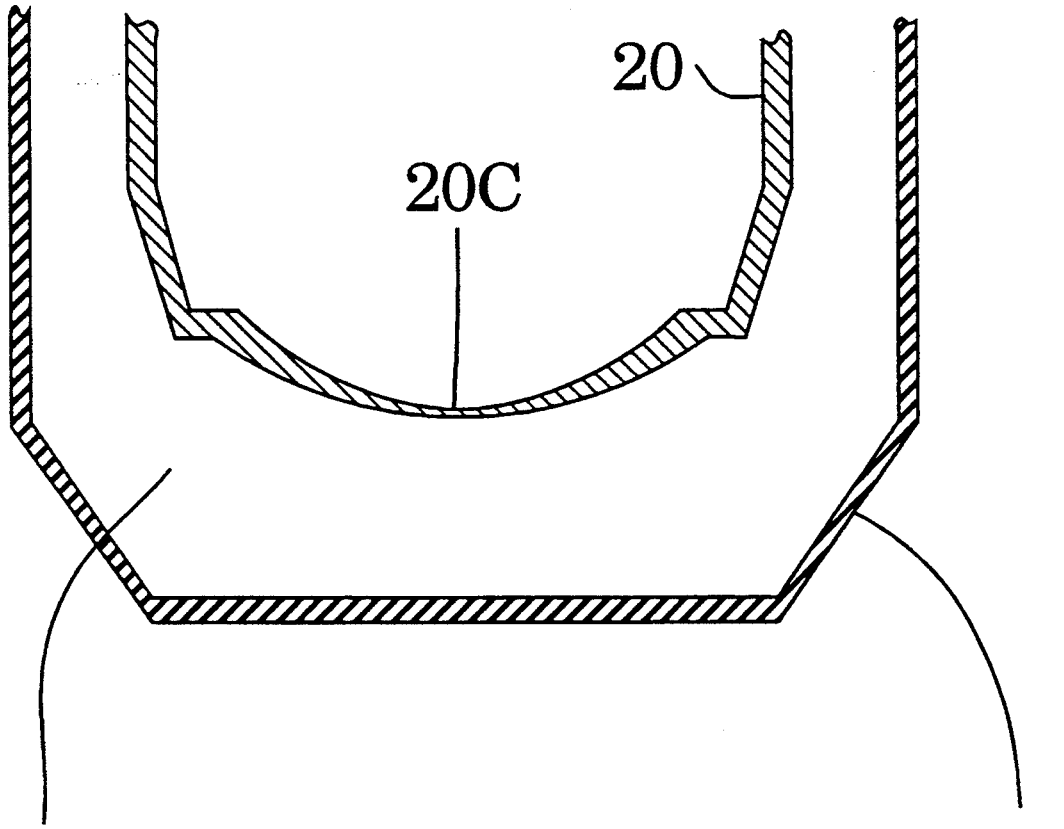
Fig. 5-B
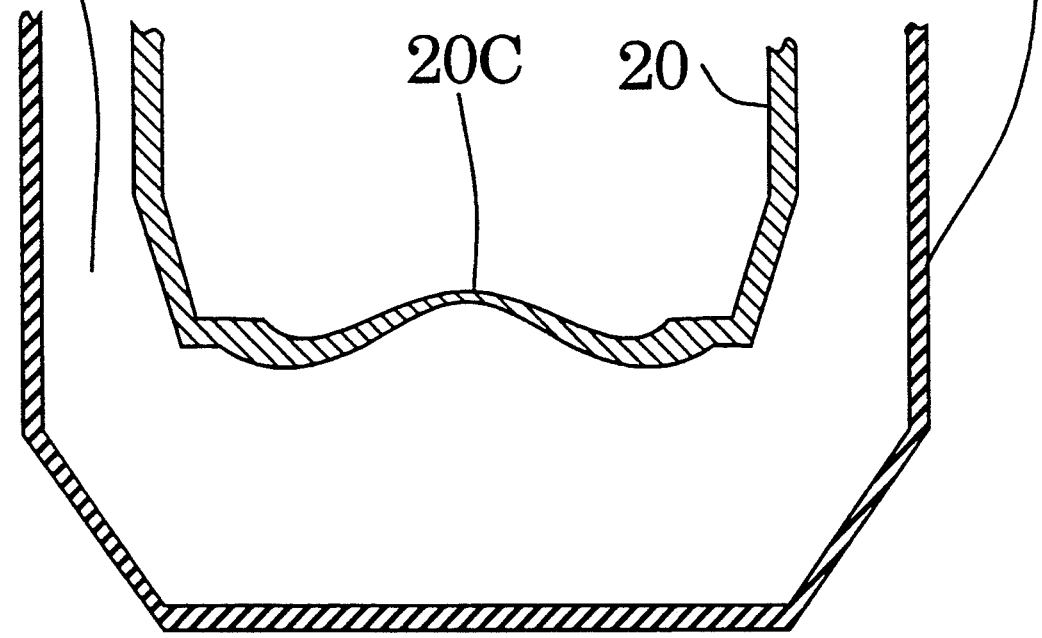

BEVERAGE CHILLING RECEPTACLE

BACKGROUND-FIELD OF INVENTION

This invention relates to an improved portable, hand-held receptacle used for cooling beverages such as beer and soft drinks for direct consumption from their canned or bottled containers. This invention is the first to make effective use of the superior cooling capabilities of natural ice as a refrigerant, to deal with the problem of ice expansion upon freezing, to feature a non-permanently sealed and refillable unit, and to provide these features in a unit that can be fully hand-assembled and produced at a lower cost than prior art.

BACKGROUND-DISCUSSION OF PRIOR ART

Most people like to partake in many different recreational activities such as camping, boating, hiking, golf, tennis, etc., as well as more leisurely activities like enjoying a picnic an the park or watching their favorite sports team on television. For most people, it is desirable in all of these situations to have a cold beverage to drink, as it refreshes you and provides added enjoyment to all your recreational activities. The problem is that canned beverages warm up very fast due to the thermal conductivity of the can. It is desirable in these situations to not only insulate the can from warming effects, but also to conduct heat away from the beverage by means of a coolant. Prior art has addressed this problem with the use of gel-based coolants or other chemically formulated coolants permanently sealed in a chamber that surrounds the beverage can. Thus, all prior art utilizing refrigerants other than natural ice suffer from a number of disadvantages:

There are a number of previously known counterparts that use a gel-based refrigerant or other semi-solid refrigerant or solid material to cool beverages. In prior art where solid materials are used as coolants, a mass of refrigerated metal or other solid material is used to conduct heat away from the beverage. The problem with solid materials is that they do not conduct heat evenly and they tend to warm up in some places faster than others. This fact is also true of widely used gel-based coolants. Prior art such as that detailed in U.S. Pat. Nos. 4,768,354 to Barnwell (1988), 4,163,374 to Moore et al (1979), and 4,183,226 to Moore (1980), have a liquid chemically treated into a gelatinous state permanently sealed within the walls of the device that acts as a coolant. This common gel is inferior to the natural ice featured in this invention due to the following: the gel's viscosity does not change significantly upon thawing, and its viscosity is too high to allow the coolant to be shaken or stirred. The act of shaking or stirring a fluid keeps all parts of the fluid at a uniform temperature. Since semi-solid gels lack this characteristic, they do not evenly conduct heat away from the source. This results in small regions of the gel warming up and no longer providing any cooling effect whatsoever.

Gels and other chemical refrigerants are used by prior art because their designs must avoid the problem of thermal expansion of natural ice. Prior art only addresses the issue of coolant expansion by leaving a void in the coolant chamber to allow the coolant to expand. This severely limits the amount of coolant that can be used. Although these types of designs can be frozen in a relatively short time, they provide insufficient thermal mass to keep a beverage palatable for more than two to three hours. In addition, since a common selling point of any product is its reusability, refrigerants such as gels and semi-solids have to be hermetically sealed within the device in order to make it reusable, because any loss of refrigerant would render such a product ineffective, as obtaining gel re-fills or other refrigerant refills would not be practical to the average consumer. Devices that contain permanently sealed coolant are evidenced by prior art U.S. Pat. Nos. 4,768,354 to Barnwell (1988), 4,163,374 to Moore et al (1979), 4,183,226 to Moore (1980), and 4,299,100 to Crisman et al (1981). An additional drawback to the design of prior art, where the cooling substance is permanently sealed into the device, is that it adds to the cost of producing the device.

Other disadvantages of prior art are those of design. In U.S. Pat. No. 4,768,354 to Barnwell (1988) for example, the design features a special bonding process of sonic welding that is required in order to seal the device and keep the coolant within the walls of the device. "Special bonding process" refers not only to sonic welding, but to any assembly process that entails more than simple hand-assembly. For example, U.S. Pat. No. 4,299,100 to Crisman et al (1981) features a method of manufacturing where two sections of the product must be press-fitted together. Thus, prior art requires more than hand-assembly and is therefore complex and costly to produce. As is evidenced in the above-referenced patents, the design of prior art requires detailed and complex, integrated methods of production and assembly that adversely affect cost. For example, prior art such as that in U.S. Pat. No. 4,768,354 to Barnwell (1988) do not feature removable insulation. This increases the cost of assembly and production, as the insulation must be included in the assembly process. Prior art such as this also features insulation that does not entirely cover the outside of the device, namely the bottom, where large thermal losses occur. This decreases the effectiveness of the device. As a result of this design, prior art such as the above referenced U.S. patent is forced to not have coolant mass on the bottom of the unit in order to avoid condensation that could potentially damage a surface upon which the unit might rest. Thus, the region devoid of coolant mass exposes the beverage to significant warming effects.

Additionally, prior art such as that in U.S. Pat. No. 4,768,354 to Barnwell (1988) contain colored gel as a coolant, and however non-toxic it may claim to be, it is unsightly and does not visually promote an environmentally conscious image.

The benefits of ice as a refrigerant in a beverage cooling unit, however, are obvious when comparing with the cost, availability, and effectiveness of gels, other semi-solids, or other solid materials.

OBJECTS AND ADVANTAGES

Accordingly, several objects and advantages of our invention are as follows:

Natural ice is used as the coolant and solves the problems that accompany the use of gels, other semi-solids, or solid refrigerants. One problem solved by the use of ice as a refrigerant is that it provides a superior cooling effect over the coolants used in prior art, as evidenced by the following. Ice undergoes a large change in viscosity as it changes phase to water. As ice thaws, the much lower viscosity of the water allows it to move freely about the ice and allows the ice and water mixture to in effect be stirred, thereby allowing the entire ice-water medium to stay just above freezing temperature as long as there is any quantity of ice remaining. The natural tilting motion of the unit associated with a user drinking a beverage provides the necessary stirring effect. For this reason natural ice has a greater thermal conductivity than all coolants utilized by prior art. For example only, tests between the prototype of this invention and the product of U.S. Pat. No. 4,768,354 to Barnwell (1988) revealed that when both were exposed to a room-temperature environment, the prototype of this invention containing ice kept a beverage cold for about five hours, compared to only about two hours for the gel product.

This invention features a unique design that accommodates the problem of volume expansion of the ice upon freezing. In this invention, it is not necessary to leave an air void in the coolant cavity to allow for coolant expansion, and a quantity of coolant comparable in volume to the beverage being cooled can be used. Prior art has no such design. Prior art uses coolants that are less effective than water as a compromise to avoid the problems associated with significant expansion of water upon freezing.

This invention features greater coolant volume, thereby further increasing the effectiveness of the invention over that of prior art. A large cavity of ice located directly under the beverage acts as a heat sink for the unit. Prior art has no such design.

There are other advantages to using ice as a coolant. Water as a coolant has the advantage of low cost, high availability, and is consumable. After the ice has turned to water, the water can be consumed by the user. Since the primary goal of a quality beverage cooling device is to provide maximum thirst-quenching satisfaction, there is a significant added efficiency to this device in that it also allows the user to consume the coolant as well as a cold beverage. Prior art has no such design. Thus, the body of this device can be separated into two pieces and the water can be emptied or consumed, and easily refilled. There are additional advantages to making a separable, non-permanently sealed device. Making it possible for the user to empty the container of its coolant makes the unit very light for carrying after use, and makes the unit more convenient to store than prior art that is of greater weight and bulk due to its sealed contents.

This invention features ice as a coolant, rather than gel, or other refrigerant. Ice has a clear, natural, aesthetically appealing image. Ice as a coolant is easy to identify and appealing to consumers, and can be readily associated with the consumption of a cold beverage. Ice is a common compound and therefore does not prompt the question in the consumer's mind, "What is this made of ?" Ice does not require any disclosure such as "safe and non-toxic." For these reasons, a portable, single-can beverage cooler that utilizes ice as the coolant has a greater practical appeal and is more likely to sell than products using colored gels or other types of refrigerants. These other types of refrigerants are not readily identifiable by themselves, and although all refrigerants utilized by prior art claim to be non-toxic to the user, many consumers will by nature doubt that which they do not understand.

This invention features removable insulation that has multiple benefits. Removable insulation allows for minimal freezing time, and if used in a transparent device it also allows the display of the aesthetically appealing clear, natural ice. Prior art utilizing colored gels and/or fixed insulators are unsightly and do not have this benefit. Additionally, removable insulation, as featured in this invention, does not require that the insulation be an integrated part of the assembly process, thus saving cost. Removable insulation also has an advantage in that it allows the user to conveniently clean the entire device in the dishwasher, if desired. This invention features a one-piece insulation that entirely encompasses the sides and bottom of the unit, unlike prior art where the bottom is left exposed to significant thermal losses.

This invention features low production and assembly costs. This invention is cheaper to build than other prior art, as evidenced by this invention's best mode. In the best mode of this invention, a plastic peanut butter jar and lid or similar receptacle can be utilized in production as two of the unit's four pieces. All modes of this invention feature a unit comprised of very common materials such as flexible and hard plastic. Availability of materials and limited amount of machining make this product very likely to sell at a profit or acceptable price level.

Other advantages of this invention are as follows:

Weight. The unit's weight is distributed so that it has a low center of gravity that provides added stability to resist toppling for recreational purposes such as boating. Prior art has no such design.

Size. The size of the device is configured so that the unit as a whole is easy to grip, without the need for bulky handles.

Safety/Health Factors. The unit uses ice as the cooling agent, unlike other prior art that use chemical gels or other cooling agents.

Effectiveness. The unit keeps a beverage at a colder temperature substantially longer than prior art.

Ease Of Use. The unit provides a simple and durable seal that is effectively engaged by hand, and that is designed for people of all ages. Additionally, unlike prior art, the unit features removable insulation, and can be placed in the dishwasher for cleaning.

Ease Of Production. The unit can be hand assembled and mass produced at a low cost. The unit's assembly requires no adhesives or special tooling and easily snaps together for full assembly in seconds, unlike prior art that requires special bonding during assembly.

Durability. The unit's durability is higher than that of prior art. Unlike prior art, the unit has no permanent seal that can be broken by a means such as dropping the unit. The unit uses only the pressure applied by a hand-tightened cap to seal the device, providing a very durable seal while still making it possible to easily empty, clean, or refill the unit.

Novelty. After primary use, the water in the unit can be directly consumed by the user, providing additional thirst quenching effects during recreational activities. This is a novelty not provided by previously known counterparts that use non-potable cooling agents. Making it possible to consume the water after primary use of the unit also provides weight reduction of the unit, making it more desirable during activities such as hiking or climbing.

Convenience. The unit makes it feasible to cool and maintain canned or bottled beverages at a palatable temperature in an environment between 70° F. and 100° F. for five hours. While doing so, the unit improves on other prior art, by being able to keep beverages at just above freezing temperature for a longer period of time. Maintenance of a cold beverage is desirable when partaking in both recreational and leisure activities. Due to its five hour window of maximum effectiveness, the unit can be taken to sports stadiums and used to supply all of one's beverage cooling needs for the duration of the event.

Seasonal Demand. The unit is not affected by seasonal demand, thereby making it marketable at all times of the year.

Operability. The unit requires no significant additional design or technical development to make it practical.

Profitability. The unit is comprised of very common materials such as flexible and hard plastic. Production is limited to the manufacturing of a one-piece inner mold and a one-piece insulation. The cap and outer shell are already available in mass quantities in the form of plastic jars and lids, e.g., for peanut butter. Thus, availability of materials and limited amount of machining make this product very likely to sell at a profit.

Cost. The unit is cheaper to assemble than other prior art, due to the fact that the unit can be assembled by hand. The unit is cheaper to ship than prior art, due to the fact that it can be distributed to the consumer with no coolant contained within the device, thereby reducing its shipping weight significantly.

Further objects and advantages of our invention will become apparent from a consideration of the drawings and ensuing description.

DRAWING FIGURES

Figure 3:
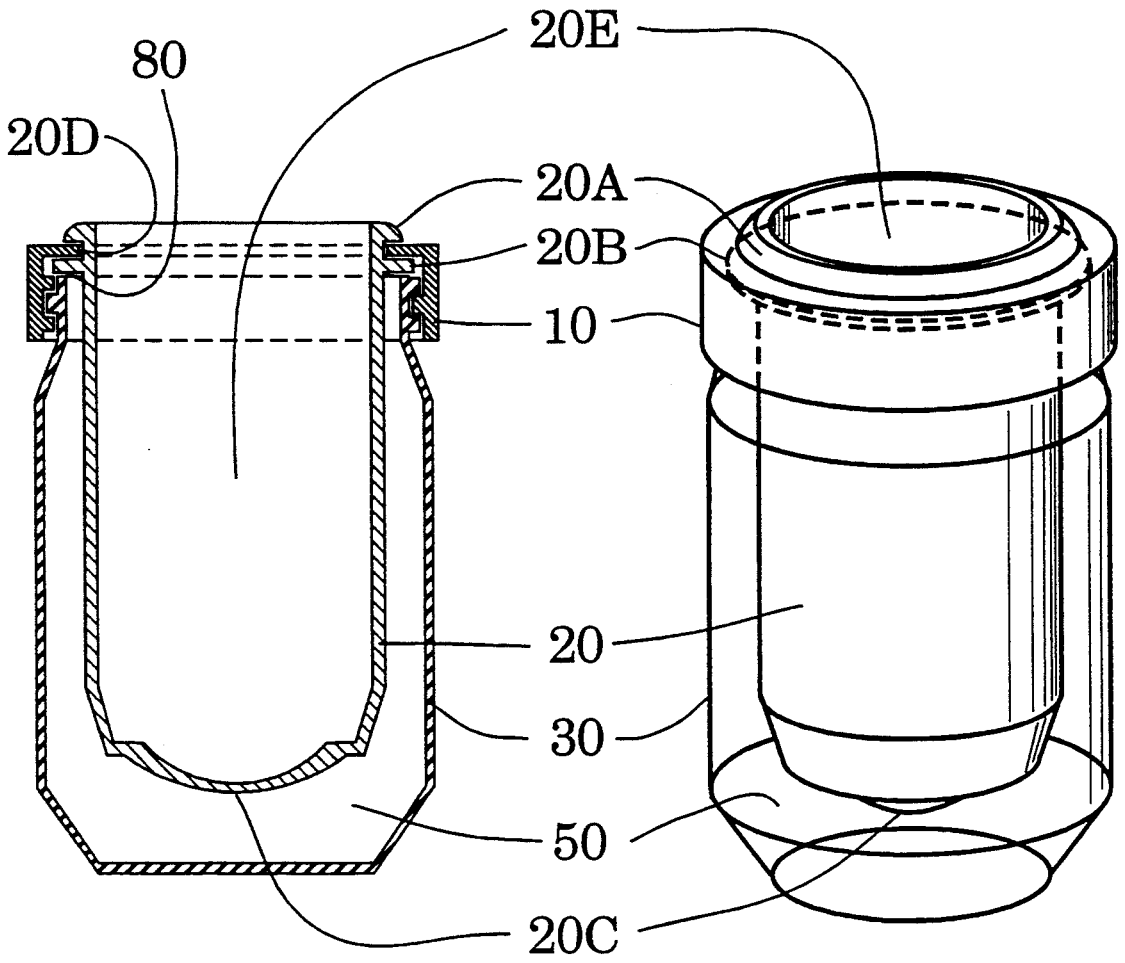

FIG. 3-A is a cross-sectional view of the preferred embodiment of the present invention, with the exception that the insulation is not shown in this figure, and shows the cap and inner shell as they would appear after being assembled and attached to the outer shell.

FIG. 3-B is a perspective view of the components displayed in FIG. 3-A and features a transparent outer shell.

Figure 4:
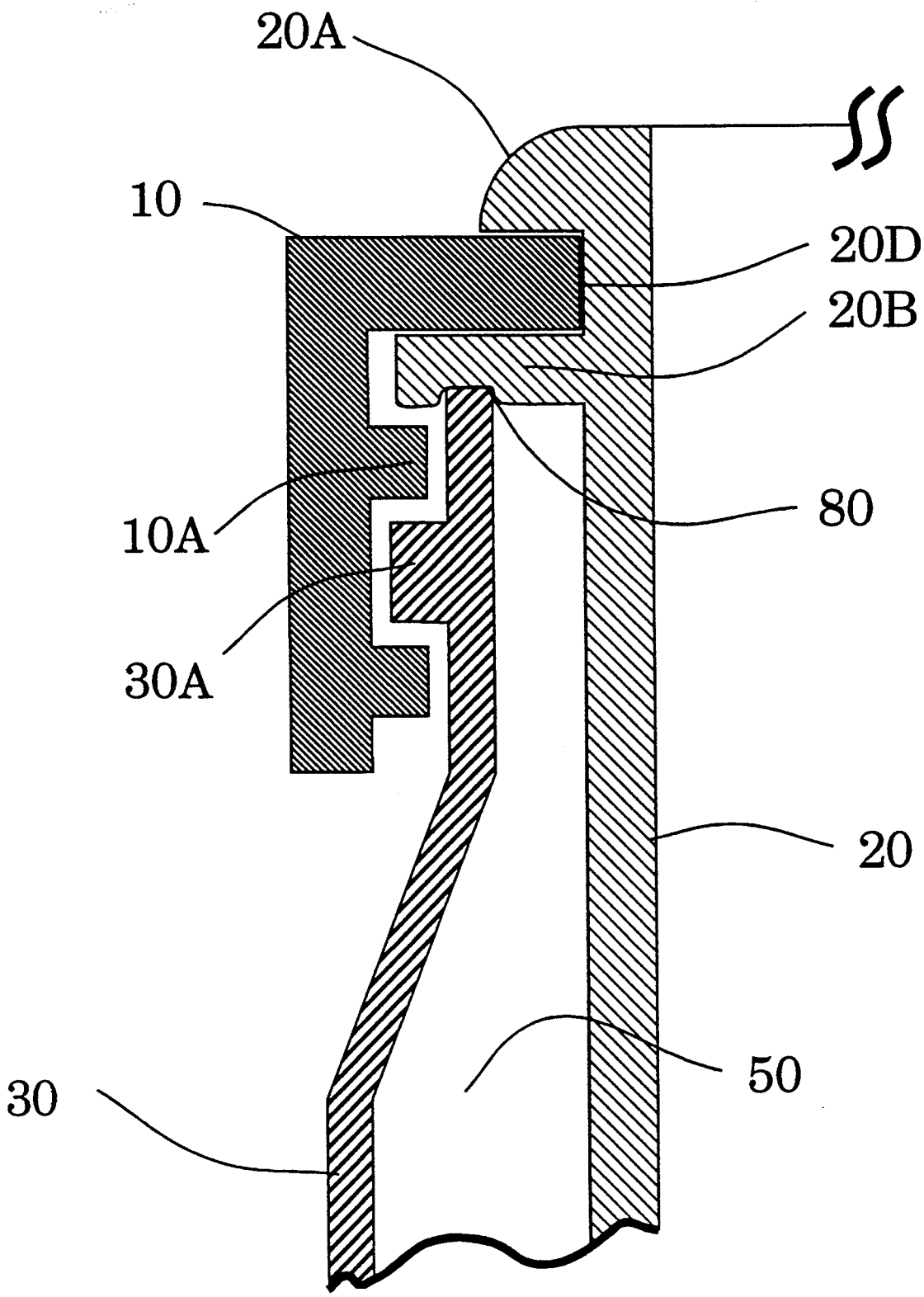

FIG. 4 is a view in detail of the portion indicated by lead line 80 in FIG. 3-A.

FIG. 5-A is a view in detail of the portion indicated by lead line 20C in FIG. 3-A, and shows the coolant expansion device in its unfrozen configuration.

FIG. 5-B shows the coolant expansion device of FIG. 5-A in its frozen configuration.

Figure 6:
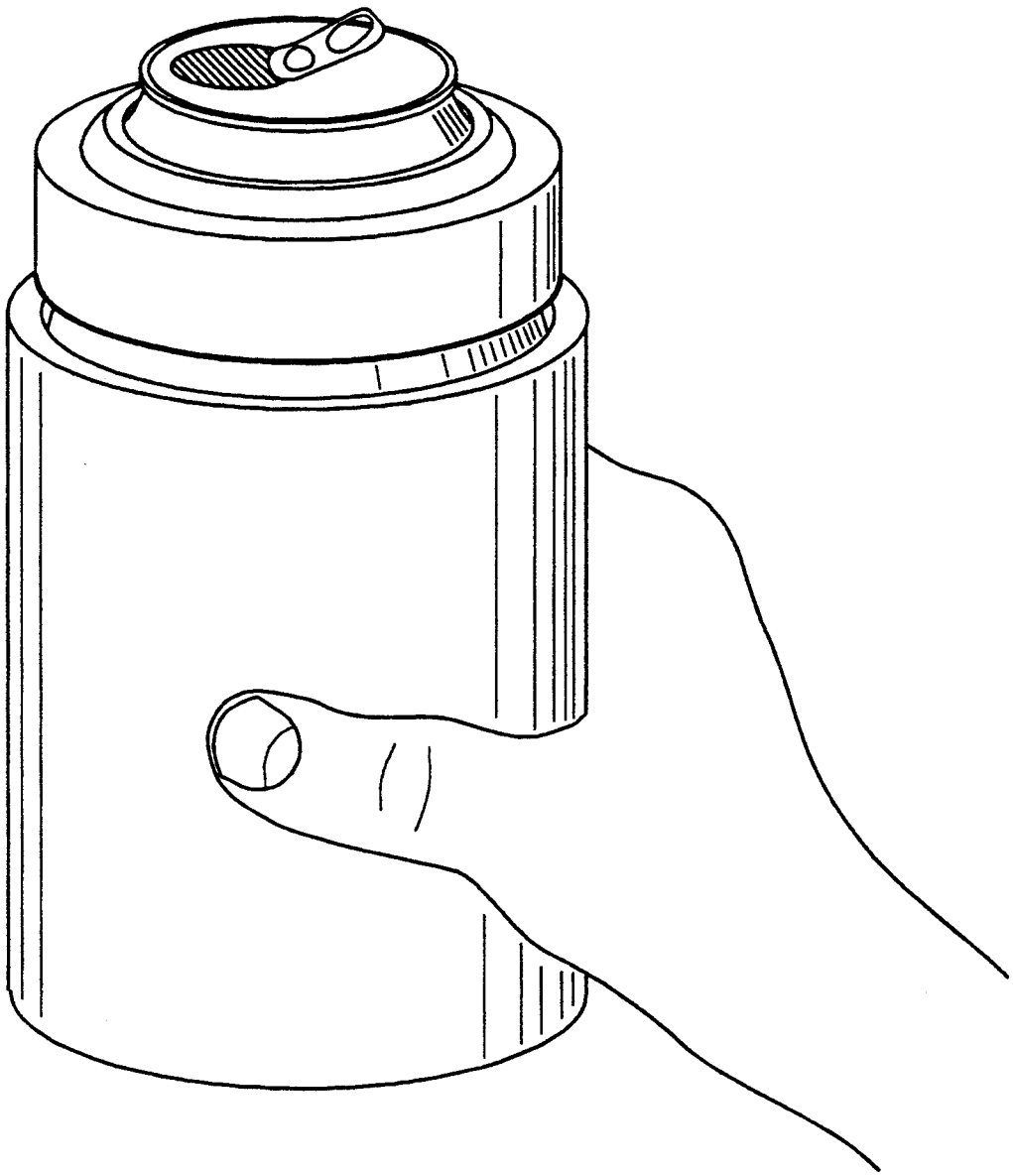

FIG. 6 is a perspective view of the invention that demonstrates the practical use of the invention and shows a beverage container as it would appear in the beverage container cavity.

REFERENCE NUMERALS IN DRAWINGS

| | | | |
|---|---|---|---|
| 10 | cap | 10A | cap threaded region |
| 20 | inner shell | 20A | annular, beveled lip |
| 20B | annular washer | 20C | coolant expansion device |
| 20D | inner shell notch | 20E | beverage container cavity |
| 30 | outer shell | 30A | outer shell threaded region |
| 40 | insulation | 50 | coolant cavity |
| 80 | coolant cavity seal | | |

DESCRIPTION OF INVENTION

Figure 1:
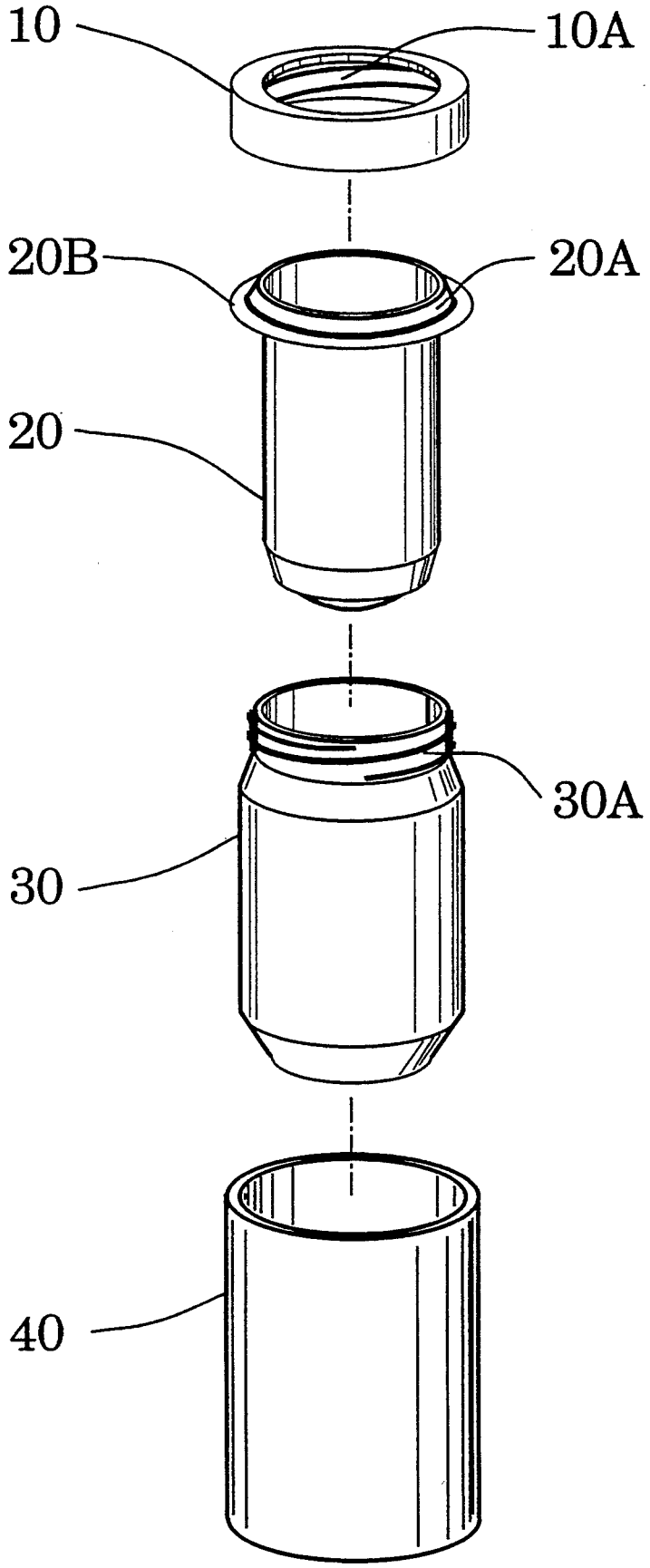
FIG. 1 is an exploded view of the preferred embodiment of the present invention.

A preferred embodiment of the beverage cooling unit of the present invention is illustrated in FIG. 1. This figure shows an exploded view of the four components of this invention, with a description of each to follow. Referring to FIG. 1, a circular, threaded cap or lid 10 snaps down and connects onto a cylindrical inner shell 20. Inner shell 20, with cap 10 secured to its top, is then placed in an outer shell 30 of larger diameter and height that is threaded at the top. Cap 10 and outer shell 30 are screwed together by means of spiral mating threads, thereby causing inner shell 20 to be effectively suspended in between, such that there is a spacial void between inner shell 20 and outer shell 30. The assembled unit of cap 10, inner shell 20, and outer shell 30 slides into the cavity of a one-piece cylindrical insulation 40 that fits snugly around and encompasses the entire sides and bottom of outer shell 30, up to the bottom edge of cap 10.

Circular cap 10 is $3\frac{3}{8}$ inches in diameter and has an edge that extends down perpendicularly from the top or horizontal face of this cap and entirely encompasses the cap's perimeter. The inner side of this cap's perpendicular edge is a spiral threaded region 10A. Cap 10 has a circular hole stamped or cut in its horizontal top face such that it may be mated with a suitable cylindrical male component, in this case the top of inner shell 20. The width of cap 10 edge is $\frac{3}{4}$ inches, but can be of any sufficient size to enable one to comfortably grip the edge and mate cap threaded region 10A with threaded region 30A of outer shell 30.

Inner shell 20 is of a cylindrical shape, with one end open and one end closed, to allow a beer or soft drink can or similar receptacle to be placed in the cavity defined by the cylindrical shape. The depth of beverage container cavity 20E in inner shell 20 is $4\frac{1}{4}$ inches and is less than that of a standard twelve ounce beer or soft drink can, so that when such a container is placed in beverage container cavity 20E, the beverage container slightly protrudes from inner shell 20 a sufficient distance to enable one to comfortably consume the beverage directly from its container. Inner shell 20 is of uniform inside diameter of $2\frac{5}{8}$ inches, precisely sized to accommodate a beer, soft drink, or similar can or container with minimal clearance between the sides of the container and inner shell 20. Located at the top of inner shell 20 is an annular, beveled lip 20A. Referring to FIG. 3-A, beveled lip 20A has a cutout or notch 20D at its base, so as to provide a means to secure cap 10 after it has been snapped onto the top of inner shell 20. A thin, annular washer 20B is located towards the top of inner shell 20, below beveled lip 20A a distance adequate to form the bottom portion of notch 20D. Notch 20D holds the horizontal top face of cap 10 snugly between annular washer 20B and beveled lip 20A. The hole in the horizontal top face of cap 10 has a precise diameter that snugly accommodates inner shell 20 and which is less than that of beveled lip 20A, and enables cap 10 to catch on beveled lip 20A to prevent upward vertical displacement of cap 10 with respect to inner shell 20. Referring to FIG. 3-A, it shows a cross sectional view of cap 10 mated with inner shell 20, and shows the horizontal top face of cap 10 resting snugly in notch 20D, between beveled lip 20A and annular washer 20B. FIG. 3-B shows exactly the same components of FIG. 3-A, but in a perspective view, to further demonstrate the relationship of the components described herein. Beveled lip 20A and annular washer 20B are permanently molded components of inner shell 20. Annular washer 20B can be of the same material as inner shell 20 or part of a composite material that comprises the mold of inner shell 20. Annular washer 20B is comprised of material that is sufficiently thick and pliable to provide an effective seal with the top edge of outer shell 30. Inner shell 20 can be comprised of plastic or other similar, relatively inexpensive, material, such that it is capable of withstanding temperature variations of 20° F. to 180° F. without cracking, rupturing, or otherwise failing. Preferably, inner shell 20 is made of plastic that can be readily formed or manufactured in a mold.

Refer to FIG. 3-A and 3-B. After cap 10 is snapped onto inner shell 20, the cap/inner shell assembly is inserted into outer shell 30, such that the sides and bottom of inner shell 20 are contained within outer shell 30, and corresponding cap 10 rests atop outer shell 30. Spiral threaded region 10A on cap 10 mates with the corresponding spiral threaded region 30A atop outer shell 30, thereby allowing cap 10 to be secured to outer shell 30 by means of a rotating or screwing action. As a result of this action, inner shell 20 is suspended in outer shell 30, in that there is a clearance or void between the sides and bottom of inner shell 20 and those of outer shell 30. The total volume of this void comprises a coolant cavity 50, wherein a liquid refrigerant may be contained.

In the preferred embodiment of this invention, water is placed into coolant cavity 50 prior to inserting cap-/inner shell assembly into outer shell 30 and screwing it on. Once the cap is tightened by the user, the annular washer 20B seals the water into coolant cavity 50 by serving as a partition between cap 10 and the top edge of outer shell 30, as shown in FIG. 4. The force of tightened cap 10 pinches the pliable material of annular washer 20B such that it acquires water-tight contact with outer shell 30 and creates a coolant cavity seal 80, which prevents leakage from coolant cavity 50. The entire unit, with the entire volume of coolant cavity 50 filled with water, is placed into a suitable freezing chamber such as a freezer compartment of a refrigerator. As shown in FIG. 3-A, an ice expansion device 20C is located at the bottom of inner shell 20. FIG. 5-A shows ice expansion device 20C in its outwardly formed unfrozen configuration, while FIG. 5-B shows the corresponding inwardly deformed frozen configuration of the device.

Refer to FIG. 1. Once components cap 10, inner shell 20, and outer shell 30 are connected, they slide into insulation 40. Ice is enclosed between inner shell 20 and outer shell 30 in coolant cavity 50. Insulation 40 is a one-piece cylindrical insulation, enclosed on its bottom, which encompasses the entire outer surface of outer shell 30 up to the bottom edge of cap 10. Insulation 40 can be made of any soft, elastic, and pliable material. The preferred embodiment of the present invention utilizes a material for such a purpose that is of uniform thickness, and has sufficient insulating properties such that the efficiency of the present invention is not compromised. Preferably, insulation 40 is made of molded, dense, foam rubber or other soil-resistant material. A thickness of insulation 40 of $\frac{1}{4}$ inches or less is desirable, as this enables the unit to be held comfortably in hand without the need for a bulky and cumbersome handle. Reference to FIG. 6 shows a perspective view of the preferred embodiment of this invention, with a beverage container located in the device.

Figure 2:
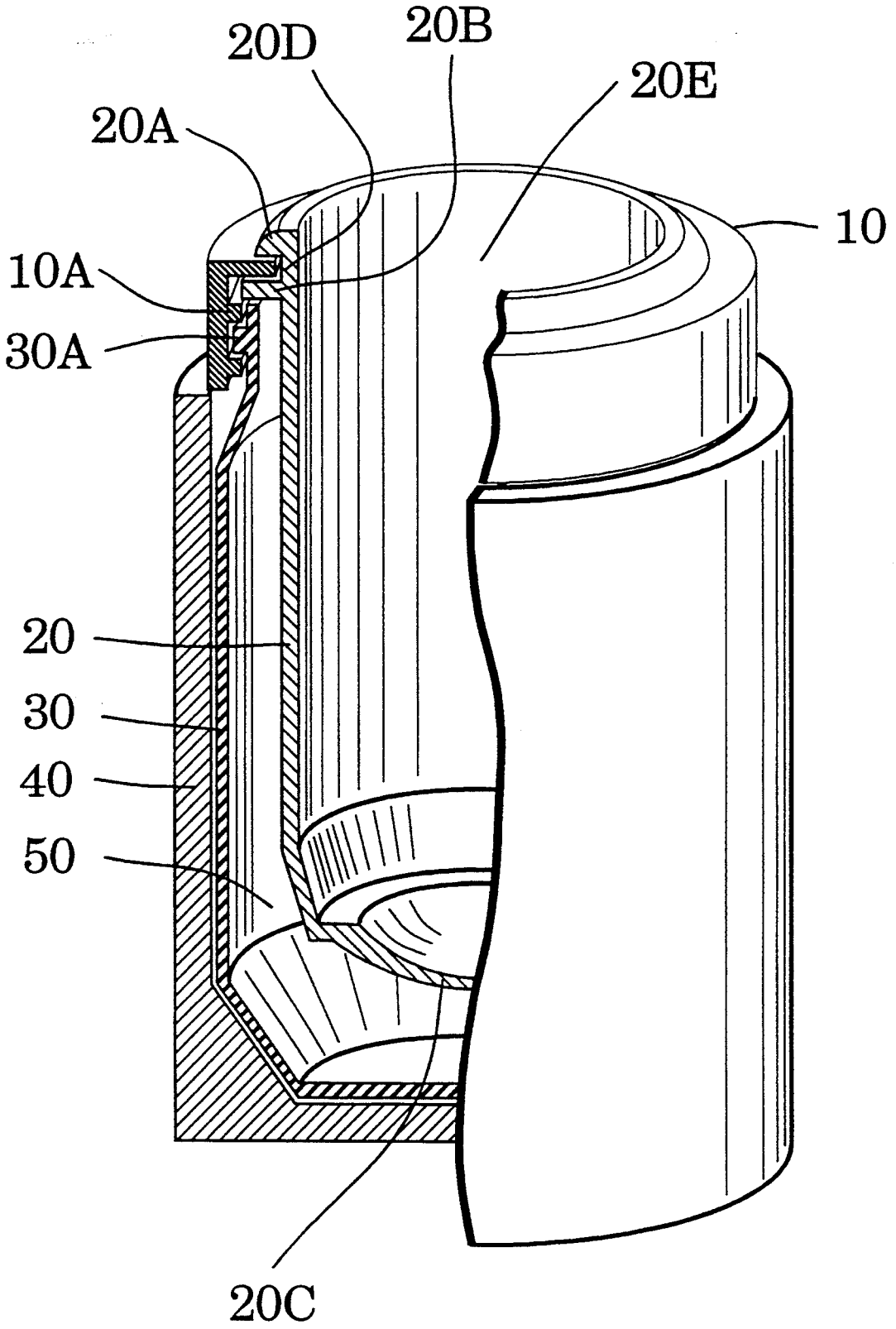
FIG. 2 is a perspective view of the present invention, with a cutout displaying the interior as it would appear with no coolant in the coolant cavity, and no beverage container displayed within the beverage container cavity.

FIG. 2 is a perspective view of this invention, with a cut-away exposing the inner components of the beverage chilling receptacle.

In the preferred and best mode of this invention, cap 10 and outer shell 30 comprise a container that is of the same size and shape of a plastic peanut butter container or similar receptacle, such that the jar and cap of such a container provide threaded closure, and are of sufficient diameter and height to facilitate their use in this invention.

OPERATION OF INVENTION

The preferred embodiment of this invention is shown as an exploded view in FIG. 1. It should be kept in mind, however, that cap 10 and inner shell 20 are shown exploded in this figure only to show that these two components are two separate pieces, but it should be emphasized that they are in fact assembled in such a way that they can be considered as one unit to the user, as defined by the following. Cap 10 and inner shell 20 snap together, as they are shown in FIG. 3-A. This process can be carried out by the user, or preferably carried out prior to distribution of the product to the consumer. Thus, all that the user need do is fill outer shell 30 with water, insert the previously snapped-together cap/inner shell assembly into outer shell 30, thereby displacing and expelling excess water, grasp cap 10 by hand and rotate until it is tight, thereby containing the water within the designated coolant cavity 50, and lastly place the entire unit into the freezer. Once the unit is frozen, the user simply removes the unit from the freezer, slides it into insulation 40, and inserts a room temperature or refrigerator-cooled canned or other suitably contained beverage into beverage container cavity 20E. Accordingly, the beverage is positioned with respect to the volume of ice in coolant cavity 50 to facilitate chilling. The volume and distribution of ice in coolant cavity 50, the close thermal contact between the beverage container and the interior walls of beverage container cavity 20E, coupled with insulation 40 surrounding the device, expedite cooling of the beverage to a temperature of 33° F.

The preferred embodiment and design of the present invention is such that producing the device would most readily be carried out in the following way. Cap 10 has a circular hole stamped or cut through its horizontal top face. By centering the hole in cap 10 on annular, beveled lip 20A and applying a sufficient force, by hand, cap 10 snaps down and is wedged between beveled lip 20A and annular washer 20B. This portion of the present invention thereby requires no further assembly. Referring to FIG. 1, beveled lip 20A is a part of inner shell 20, and as such both are formed by an injection mold or similar mold. This is also true of annular washer 20B, as it is a molded part of inner shell 20. One function of annular washer 20B is it serves as a seat for the horizontal top face of cap 10, as shown in FIG. 4. Annular washer 20B also functions as the closure and seal of coolant cavity 50 as shown in FIG. 4.

In the preferred embodiment of the present invention, inner shell 20 is manufactured such that there is a notch 20D, in between beveled lip 20A and annular washer 20B, and notch 20D has a width sufficient to accommodate the horizontal top face of cap 10 in a secure fashion. This eliminates the need for sonic welding, or other types of complex and costly bonding, to achieve a durable device. This also makes it possible to utilize a threaded cap and threaded jar of a plastic peanut butter container in the manufacturing process to represent cap 10 and outer shell 30, respectively. Cutting a properly sized circular hole through cap 10 allows it to be hand assembled to inner shell 20 by pushing it over beveled lip 20A and into contact with annular washer 20B, thus snapping it into notch 20D. Threaded region 10A on cap 10 and threaded region 30A on outer shell 30 serve to enable cap 10 and affixed inner shell 20 to be hand fastened with outer shell 30, and in conjunction with annular washer 20B, make coolant cavity 50 water tight. This same closure process makes cap 10 and outer shell 30 just as effortless to separate as it does to fasten them together. This allows the user to refill the water in the unit after it has been drunk, or emptied for cleaning in the dishwasher, if desired. The water-tight construction makes it perfectly acceptable for the water to remain in the unit at all times as well. The snap-together design of the present invention, coupled with the utilization of threaded components, makes this invention fully capable of being hand-assembled, either fully or in part by the user, in seconds, thereby completely eliminating the assembly costs associated with machine assembly, special bonding, or other special tooling.

Coolant expansion device 20C on the bottom of inner shell 20 is shown in FIGS. 3-A and 3-B, and with greater detail in FIGS. 5-A and 5-B. Coolant expansion device 20C has the function of providing a volume in which water may expand upon changing phase to ice, while also preventing water from occupying such a volume before it freezes. Coolant expansion device 20C works in the following way: coolant expansion device 20C, in its unfrozen configuration of FIG. 5-A, shown in cross-section, is an outward, curved formation in the bottom face of inner shell 20. This region is sufficiently outwardly curved as to resist inward deformation caused by the static water pressure acting perpendicular to the bottom face of inner shell 20. The cross-sectional thickness of the material that forms this region, however, is tapered toward the crest, such that additional forces created when the coolant expands will deform the surface inward, as in FIG. 5-B. Upon freezing, this inward deformation increases the volume of coolant cavity 50, while producing a corresponding decrease in volume in beverage container cavity 20E. This decrease in volume of beverage container cavity 20E is such that the plastic material that comprises the bottom face of inner shell 20 recesses into a region under the beverage container, while leaving the space for the beverage container itself undisturbed. Coolant expansion device 20C maintains its inwardly deformed shape until an adequate quantity of ice has thawed such that hydrostatic forces are reduced, at which time the designed outward curvature of coolant expansion device 20C forces its return to the pre-frozen shape.

A device such as coolant expansion device 20C makes it possible for the entire volume of coolant cavity 50 to be occupied by water prior to freezing, meaning there is no need to leave an air void in coolant cavity 50 to allow for coolant expansion. Additionally, coolant expansion device 20C concentrates the total ice expansion in coolant cavity 50 into an area on the bottom of beverage container cavity 20E. This prevents any deformations in the side walls of beverage container cavity 20E that might obstruct insertion or removal of a beverage container.

Other embodiments of the present invention are as follows.

For exclusive use with beverage cans, coolant expansion device 20C may be designed to completely invert itself upon achieving its frozen configuration, thereby coming into close intimate contact with the cup-shaped indentation commonly present on the bottom of 12-ounce beverage cans.

A cylindrical extension, open on both ends, of the same inner diameter as that of inner shell 20 of our preferred embodiment, could be fastened to the top of inner shell 20, by means of spiral threading or otherwise, such that when no beverage container is located within beverage container cavity 20E a beverage of greater volume than 12 ounces can be directly poured into beverage container cavity 20E.

An additional washer of material different from that of inner shell 20 may be used to improve coolant cavity seal 80.

Inner shell 20 and cap 10 can be molded as a single unitized piece.

The means by which cap 10 is fastened to outer shell 30 can be by threading or any other means that allows hand assembly.

SUMMARY, RAMIFICATIONS, AND SCOPE OF INVENTION

Thus the reader will see that this invention provides a hand held beverage cooling device that uses the superior cooling effects of natural ice as an enclosed refrigerant, features an innovative design for dealing with the problem of ice expansion, features a non-permanently sealed and refillable coolant chamber, and provides these features in a device that can be fully hand assembled and produced at an economical price. This invention offers novelty not found in prior art, such as:

- a non-permanently sealed coolant that is consumable and very economically and practically refilled;
- a design that includes all hand-assembled and hand-fastened, separable components, some of the functions of which are to provide a means to expel the coolant for reduction of weight during activities such as hiking, for making it possible to consume the water when it has turned from ice to further quench one's thirst, to make it possible to clean the unit in the dishwasher, and to enable the product to be produced at a low cost;
- it features a transparent outer shell which displays clear, natural ice, that promotes an environmentally conscious image, and does not feature unsightly-colored, less effective gels to keep the beverage cold; and
- it features a device that effectively solves the problems associated with ice expansion, such as rupturing, cracking, or deforming in the wrong place, such as on the sides of the beverage container chamber that would affect removal or insertion of the beverage container.

While the above description contains many specificities, these should not be construed as limitations on the scope of the invention, but rather as an exemplification of one preferred embodiment thereof. Other variations are possible. For example, the beverage chilling receptacle can have sizes and shapes other than that of a plastic peanut butter container or similar receptacle. Additionally, the connection of cap 10 to inner shell 20 can be of other means such as those described at the end of the preceding section.

Thus the scope of the invention should be determined by the appended claims and their legal equivalents, rather than by the examples given.

We claim:

1. An improved hand-held beverage chilling receptacle, used for the purpose of conducting heat away from a beverage container, including two cylindrical receptacles, or shells, enclosed on one end, of different diameter and height, such that placement of an inner shell inside an outer shell forms a fluid-tight coolant cavity wherein a liquid may be placed that when frozen facilitates refrigeration of said beverage container disposed within a cylindrical cavity enclosed by said inner shell, with said outer shell and said inner shell joined by means of an annular cap affixed to an open end of said inner shell, creating a seal between said inner shell and said outer shell containing said liquid within said coolant cavity, and with an insulation encompassing the exterior of said outer shell; the improvement wherein said coolant cavity is resealable and a means for making said coolant cavity resealable, and said inner shell has an outwardly-formed closed end that is tapered such that the thickness of said end increases with increasing radius such that said end deforms inward upon exposure to forces created by an expanding coolant and shape of said end is restored upon removal of forces created by an expanding coolant.

2. The beverage chilling receptacle of claim 1 wherein said annular cap is secured to said inner shell by a notch formed by an annular washer integral to said inner shell and an annular beveled lip encompassing the edge of said open end of said inner shell.

3. The beverage chilling receptacle of claim 2 wherein said washer slightly overlaps the edge of an open end of said outer shell such that when said washer is forced into contact with the edge of said open end of said outer shell by said annular cap, said washer provides said seal of said coolant cavity.

* * * * *